US006712737B1

(12) United States Patent
Nusbaum

(10) Patent No.: US 6,712,737 B1
(45) Date of Patent: Mar. 30, 2004

(54) EXERCISE APPARATUS WITH VIDEO EFFECTS SYNCHRONIZED TO EXERCISE PARAMETERS

(76) Inventor: Neil Nusbaum, 4413 Keystone Ave., Culver City, CA (US) 90232

( * ) Notice: Subject to any disclaimer, the term of this patent is extended or adjusted under 35 U.S.C. 154(b) by 0 days.

(21) Appl. No.: 09/665,539

(22) Filed: Sep. 19, 2000

Related U.S. Application Data

(60) Provisional application No. 60/176,973, filed on Jan. 19, 2000, and provisional application No. 60/158,625, filed on Oct. 6, 1999.

(51) Int. Cl.[7] ..... A63B 22/00
(52) U.S. Cl. ..... 482/8; 482/57; 482/900
(58) Field of Search ..... 482/1–9, 51, 57–59, 482/63–65, 900–902

(56) References Cited

U.S. PATENT DOCUMENTS

| | | | |
|---|---|---|---|
| 4,512,567 A | 4/1985 | Phillips | |
| 4,542,897 A | 9/1985 | Melton et al. | |
| 4,637,605 A | 1/1987 | Ritchie | |
| 4,976,435 A | 12/1990 | Shatford, III et al. | |
| 5,591,104 A | 1/1997 | Andrus et al. | |
| 5,645,513 A | 7/1997 | Haydocy et al. | |
| 5,743,835 A | 4/1998 | Trotter | |
| 5,890,995 A | 4/1999 | Bobick et al. | |
| 6,126,571 A | * 10/2000 | Parks | 482/4 |

FOREIGN PATENT DOCUMENTS

| | | |
|---|---|---|
| EP | 0 379 393 A | 7/1990 |
| EP | 0 736 311 A | 10/1996 |
| ES | 2 114 440 A | 5/1998 |
| FR | 2 755 866 A | 5/1998 |

OTHER PUBLICATIONS

International Search Report, PCT/US 00/27314, dated Jan. 24, 2001, 2 pgs.

* cited by examiner

*Primary Examiner*—Glenn E. Richman
(74) *Attorney, Agent, or Firm*—Snell & Wilmer L.L.P.

(57) ABSTRACT

An apparatus for synchronizing the movement of a stationary bicycle with video effects produced on a video display of a computer, wherein the bicycle has a rear wheel, handlebars, and a pair of front wheel forks operatively engaged with the handlebars. The apparatus includes a motion sensor configured to produce a rear wheel rotation signal which corresponds to the rotation of the rear wheel. The apparatus also includes a handlebar rotation sensor assembly that is configured to produce a handlebar rotation signal which corresponds to the rotation of the handlebars about an axis. A digital signal processor is configured to receive the rear wheel rotation signal and the handlebar rotation signal and transmit output signals to the computer so that a user of the bicycle may interact with the video effects by rotating the rear wheel and the handlebars.

26 Claims, 11 Drawing Sheets

EXERCISE APPARATUS WITH VIDEO EFFECTS SYNCHRONIZED TO EXERCISE PARAMETERS

CROSS REFERENCE TO RELATED APPLICATIONS

This application claims the benefit of U.S. Provisional Application No. 60/158,625, filed Oct. 6, 1999 and U.S. Provisional Application No. 60/176,973, filed Jan. 19, 2000.

FIELD OF THE INVENTION

The present invention relates generally to stationary exercise bicycles. More particularly, it relates to stationary exercise bicycles used in conjunction with a video game in which video effects are synchronized to exercise parameters.

BACKGROUND OF THE INVENTION

Stationary bicycles are well known exercise machines used by professional athletes and recreational cyclers alike for training and/or general physical conditioning. To monitor exercise parameters, such as speed and distance, or simply to make exercising more entertaining, stationary exercise bicycles are often connected to a computer, such as a personal computer with a display screen or a video game console, such as a Sony Playstation, a Nintendo 64, or a Sega system, connected to a television screen. The computer may be configured to simulate an interactive cycling routine on the screen wherein the cyclist's exercising effort on the stationary bicycle is measured and is then synchronized to the cycling routine. Alternatively, the computer may be configured to permit the cyclist to play a video game by synchronizing the cyclist's exercising effort to moving features of the game. For examples of bicycles which are configured for interaction with a video game or computerized simulated environment, see U.S. Pat. No. 4,542,897, issued to Melton et al. on Sep. 24, 1985, U.S. Pat. No. 5,890,995, issued to Bobick et al. on Apr. 6, 1999, U.S. Pat. No. 5,591,104 issued to Andrus et al. on Jan. 7, 1997, and U.S. Pat. No. 5,645,513 issued to Haydocy et al. on Jul. 8, 1997.

Stationary exercise bicycles generally fall into one of two categories. The first category comprises those apparatus which simulate the cycling exercise but are designed only for stationary use, such as, for example, the apparatus disclosed in U.S. Pat. No. 4,512,567, issued to Phillips on Apr. 23, 1985, which is incorporated herein by reference. The second category those apparatus that permit a cyclist to retrofit a conventional bicycle for stationary use, such as, for example, the apparatus disclosed in U.S. Ser. No. 09/305,124, which is incorporated herein by this reference. The latter group provides the advantage that a cyclist can exercise indoors and outdoors without having to purchase two separate, expensive, pieces of equipment.

Conventional techniques for converting a bicycle into a stationary exercise machine generally employ a mechanical device known as a bicycle trainer which elevates the back wheel of the bicycle off the ground and operationally engages a resistance device that simulates the resistance a cyclist would experience by pedaling on a road. When the bicycle is interfaced with a computer, the speed with which the cyclist pedals is measured and converted to a signal which is supplied to the computer. Steering mechanisms are also used to allow the cyclist to steer the cycle to interface with video games. Such steering mechanisms generally employ a rotating platform which supports the front wheel of the bicycle and allows the cyclist to rotate the handlebars of the bicycle relative to the frame of the bicycle. Such steering mechanisms, however, result in side-to-side movement of the rear wheel of the bicycle as the front wheel is rotated. Such side-to-side movement may result in wear to the rear wheel and bicycle trainer, and may ultimately cause the rear wheel to become disengaged from the bicycle trainer or the bicycle, resulting in injury to the cyclist.

Thus, a need exists for a safe and stable exercise bicycle apparatus that will permit a conventional bicycle to be used as a stationary exercise machine and that can be operationally engaged with a computer, such as a video game console or personal computer, so that a user can play a video game or participate in an exercise simulation.

SUMMARY OF THE INVENTION

These and other aspects of the present invention will become more apparent to those skilled in the art from the following non-limiting detailed description of preferred embodiments of the invention taken with reference to the accompanying figures.

In accordance with an exemplary embodiment of the present invention, an apparatus is provided for synchronizing the movement of a stationary bicycle with video effects produced on a video display of a computer, wherein the bicycle has a rear wheel, handlebars, and a pair of front wheel forks operatively engaged with the handlebars, and further wherein the synchronizing apparatus includes a motion sensor. The motion sensor is configured to produce a rear wheel rotation signal which corresponds to the rotation of the rear wheel. The apparatus also includes a handlebar rotation sensor assembly that is configured to engage the pair of front wheel forks and produce a handlebar rotation signal which corresponds to the rotation of the handlebars about an axis. A digital signal processor is configured to receive the rear wheel rotation signal and the handlebar rotation signal and transmit output signals to the computer so that a user of the bicycle may interact with the video effects by rotating the rear wheel and the handlebars.

In accordance with another embodiment of the present invention, the apparatus includes a speed scaling potentiometer configured to permit scaling of the rear wheel rotation signal.

In accordance with a further embodiment of the present invention, the apparatus includes a steering scaling potentiometer configured to permit scaling of the handlebar rotation signal.

In accordance with yet another embodiment of the present invention, the apparatus includes a rear wheel support assembly removably connected to the stationary bicycle and configured to permit rotation of the rear wheel.

In accordance with yet a further embodiment of the present invention, the apparatus includes a stabilizing member attached at a first end to the rear wheel support assembly and attached at a second end to the handlebar rotation sensor assembly.

In accordance with another embodiment of the present invention, an apparatus is provided for permitting a user of an exercise device to transmit user commands to a computer to interact with a video game produced on a video display associated with the computer. The apparatus includes a game controller configured to produce signals for controlling the video game. The apparatus also includes a digital signal processor configured to receive the signals from the game controller and transmit output signals to the computer so that the user may interact with the video game by actuating the game controller while using the exercise device.

These and other aspects of the present invention are described in the following description, claims and appended drawings.

BRIEF DESCRIPTION OF THE DRAWING FIGURES

Exemplary embodiments of the present invention will hereafter be described in conjunction with the appended drawing figures, wherein like designations denote like elements, and:

FIG. 1 is a side view illustration of a stationary bicycle apparatus according to an embodiment of the present invention.

FIG. 2*a* is a top view illustration of a digital signal processor device attached to handlebars of a bicycle, according to an embodiment of the present invention.

FIG. 2*b* is a top view illustration of a digital signal processor device according to an embodiment of the present invention.

FIG. 2*c* is a top view illustration of a digital signal processor device according to another embodiment of the present invention.

FIG. 3*a* is a perspective front view of a handlebar rotation sensor assembly according to an embodiment of the present invention.

FIG. 3*b* is a side view of a handlebar rotation sensor assembly according to an embodiment of the present invention.

FIG. 3*c* is a side view of a handlebar rotation sensor assembly according to another embodiment of the present invention.

FIG. 3*d* is a side view of a rotation member of a handlebar rotation sensor assembly according to another embodiment of the present invention.

DETAILED DESCRIPTION OF THE INVENTION

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth.

Figure 1:
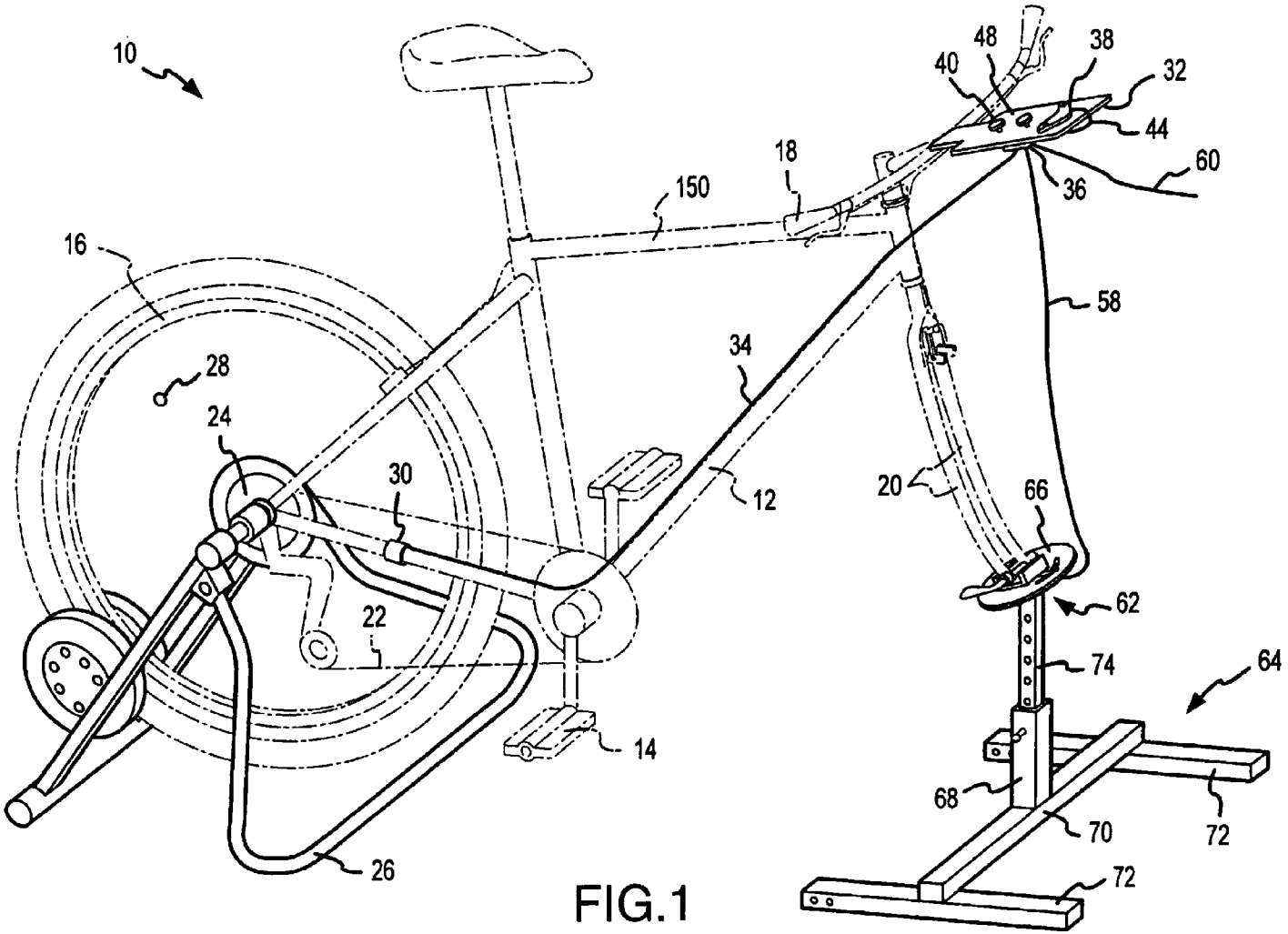

FIG. 1 illustrates an exercise apparatus of the present invention. A stationary exercise bicycle apparatus 10 of the present invention is operationally engaged with a bicycle 150 having a frame 12, a pair of pedals 14, a rear wheel 16, handlebars 18 and front forks 20. By cranking pedals 14, a user can rotate rear wheel 16 via a bicycle chain 22 and gears 24. Bicycle 150 is mounted on a bicycle trainer 26, which is suitably configured to allow bicycle 150 to be used as a stationary exercise device.

Bicycle apparatus 10 may have a rotation sensing device that includes a magnet 28 and a magnet-sensing device 30. Magnet 28 is attached to a spoke (not shown) of rear wheel 16 and magnetic sensing device 30 is attached to frame 12. Upon rotation of rear wheel 16, magnet 28 moves proximate to magnetic sensing device 30, which, upon sensing magnet 28, sends a signal to a digital signal processor device 32 via a cable 34. A digital signal processor 36 (described below) of the digital signal processor device 32 converts the signal from magnetic sensing device to a speed signal representing the speed of rear wheel 16. This speed signal is then transmitted to a computer, such as a personal computer or video game console (not shown), via an output cable 60. While FIG. 1 illustrates bicycle apparatus 10 employing only one magnet 28, it will be appreciated that more than one magnet may be employed to increase speed-sensing accuracy. It will be further appreciated that the speed-sensing device may use any suitable sensor, such as, for example, an optical encoder, which may measure the rotation of rear wheel 16 or, alternatively, which may suitably measure the speed of chain 22, the rotation of pedals 14, or the like.

Figure 2B:
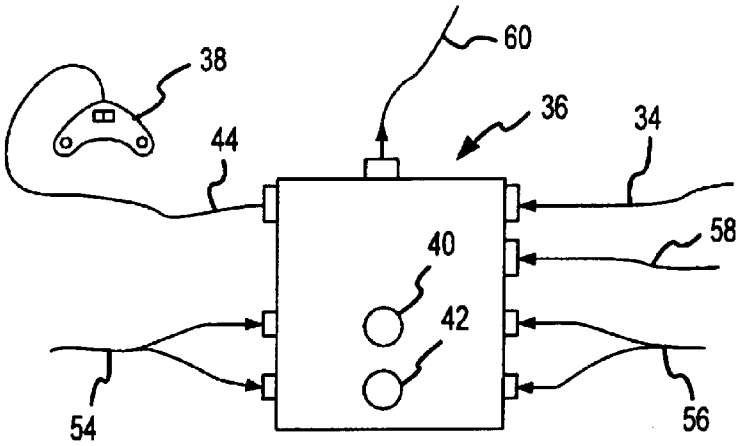
Figure 2C:
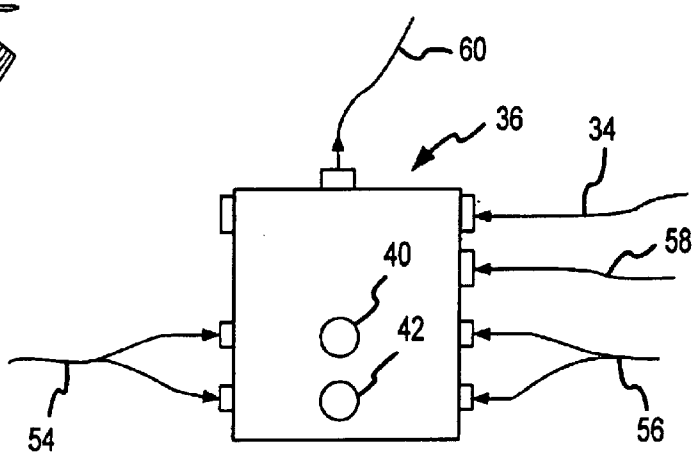
Figure 2A:
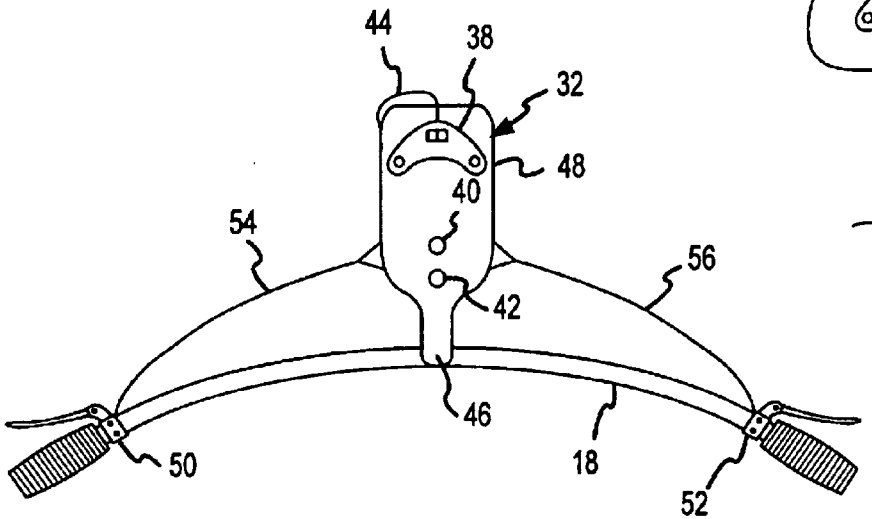

Referring now to FIGS. 1 and 2*a*, digital signal processor device 32 may be attached to handlebars 18 via a fastener 46, such as, for example, a bracket, a clamp, a hook and loop device, or the like. Digital signal processor device 32 may include a control panel 48, digital signal processor 36, a speed scaling potentiometer 40, a steering scaling potentiometer 42 (described below), and an output cable 60 which provides output signals from digital signal processor 36 to a computer (not shown), such as a video game console or a personal computer. Speed scaling potentiometer 40 is suitably configured to be adjustable by a user to scale the speed calculated by digital signal processor 36 to a speed or speed range appropriate for a video game being viewed by the user. For example, if the user is pedaling at 20 miles per hour but is playing a video game requiring racing speeds of 80 miles per hour, the user can adjust speed scaling potentiometer 40 so that an actual pedaling speed of 20 mph is scaled to produce an output signal representing 80 miles per hour, which is then provided to the video game console or personal computer via output cable 60.

Digital signal processor device 32 may also communicate with a conventional game controller 38 which is configured to cooperate with digital signal processor 36 in any suitable manner, for example via a cable 44, and which is mounted to control panel 48 for easy access by the user. Game controller 38, such as the Sony® Dual Analog game controller, the Microsoft® Sidewinder®, or the like, may employ buttons or a conventional joystick. By pressing the buttons or moving the joystick, a user is able to control the game being played without having to dismount bicycle 150. For example, game controller 38 may be used to start the game, set up the game, pause the game or reconfigure game parameters. Signals from game controller 38 are conveniently transmitted to digital signal processor 36 using a standard input protocol and are processed by digital signal processor 36. Output signals from digital signal processor 36 are then transmitted via cable 60 to the computer so that the user may interact with the video game by actuating the game controller.

Digital signal processor device 32 may further include left action buttons member 50 and right action buttons member 52 which may be mounted onto handlebars 18 for convenient access by the user. Left action buttons member 50 and right action buttons member 52 may be mounted to handlebars 18 by any suitable device, such as brackets, clamps, hook and loop mechanisms and the like. Left action buttons member 50 and right action buttons member 52 may be selectively pressed by the user to provide output signals from digital signal processor 36 to the video game console or personal computer to operate features of the game. For example, buttons of left action buttons member 50 and right action buttons member 52 can be used to cause a character of the video game to jump, fire, flip, punch, and the like. While shown in FIG. 2*a* with two buttons, it will be appreciated that left action buttons member 50 and right action buttons member 52 may include any number of buttons or other suitable actuators to permit a user to control features of a video game. Alternatively, left action buttons member 50 and/or right action buttons member 52 may be used by the user in place of game controller 38 to permit the user to start the game, setup the game, pause the game or reconfigure game parameters. Using left action buttons member 50 and/or right action buttons member 52, the user can control the video game being played without removing his or her hands from the handlebars.

FIGS. 2*a* and 2*b* illustrate signal inputs to and outputs from digital signal processor 36. Signals from left action buttons member 50 may be conveniently transmitted to digital signal processor 36 via cable 54 and signals from right action buttons member 52 may be conveniently transmitted to digital signal processor 36 via cable 56. Cable 54 and cable 56 are illustrated in FIGS. 2*a* and 2*b* as having two inputs to digital signal processor 36 because left action buttons member 50 and right action buttons member 52 are illustrated employing two buttons each; however, it will be appreciated that cables 54 and 56 may have inputs to digital signal processor 36 based on the number of buttons or actuators employed. Signals from game controller 38 may be conveniently transmitted via cable 44. Speed input signals may be conveniently transmitted to digital signal processor 36 from magnetic sensing device 30 via cable 34. In addition, a steering sensitivity signal from steering sensitivity potentiometer 112, discussed below, may be conveniently transmitted to digital signal processor 36 via a cable 58.

Digital signal processor 36 is configured to compute and convert the above-identified input signals to output signals that are required by the computer, such as a video game console or a personal computer, through an available connection port, such as a DB-15 game port, a serial port, a USB port or game machine-specific ports, such as the ports required for Sony Playstations, Sega Dreamcast consoles and the like. Output signals are transmitted to the computer via cable 60.

FIG. 2*c* illustrates an alternative embodiment of digital signal processor device 32 wherein game controller 38 is not employed. This embodiment typically may be used when bicycle apparatus 10 is used in association with a personal computer where a keyboard and mouse, as opposed to game controller 38, may be required to configure or reconfigure a video game or when digital signal processor device 32 includes its own actuators to perform the functions of game controller 38.

Figure 3A:
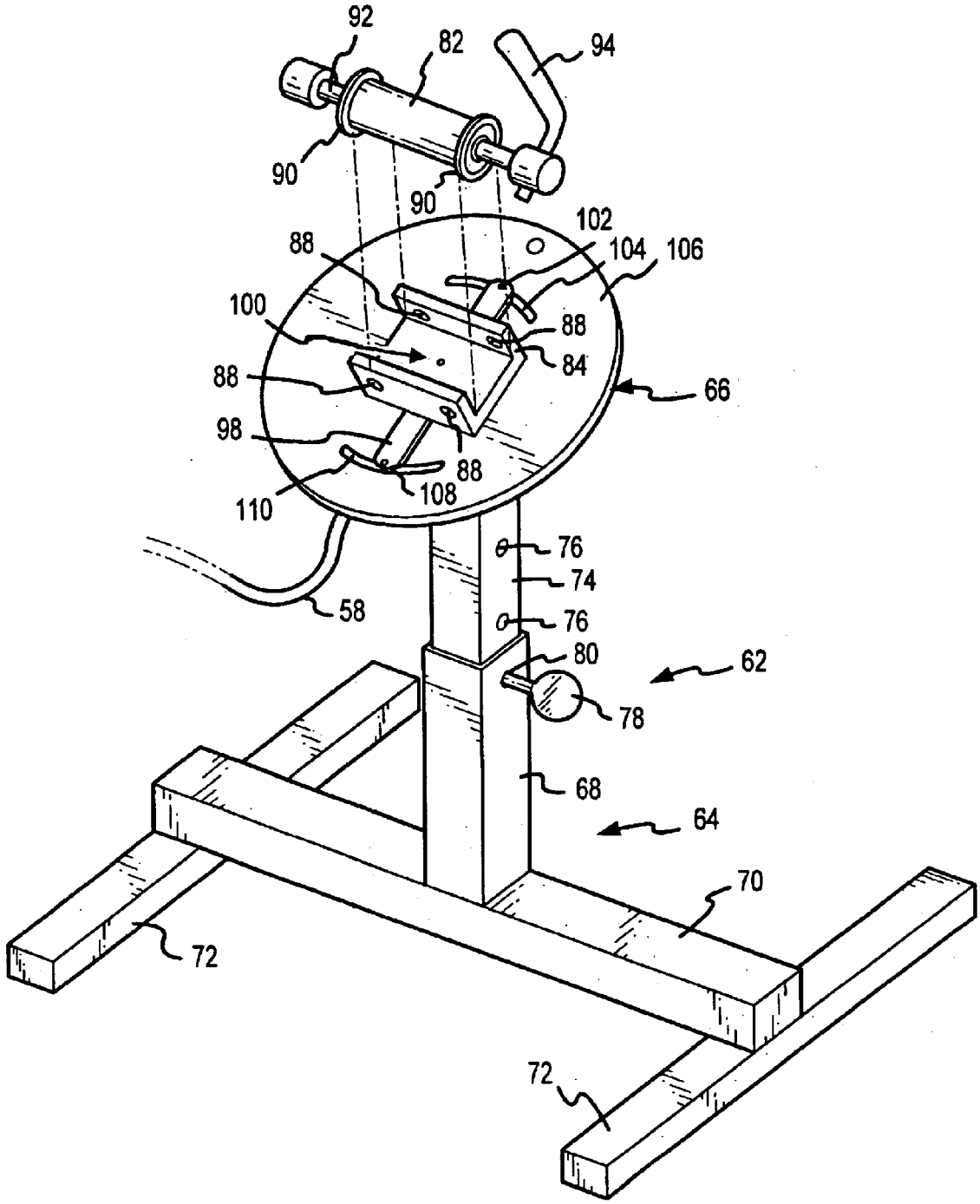
Figure 3B:
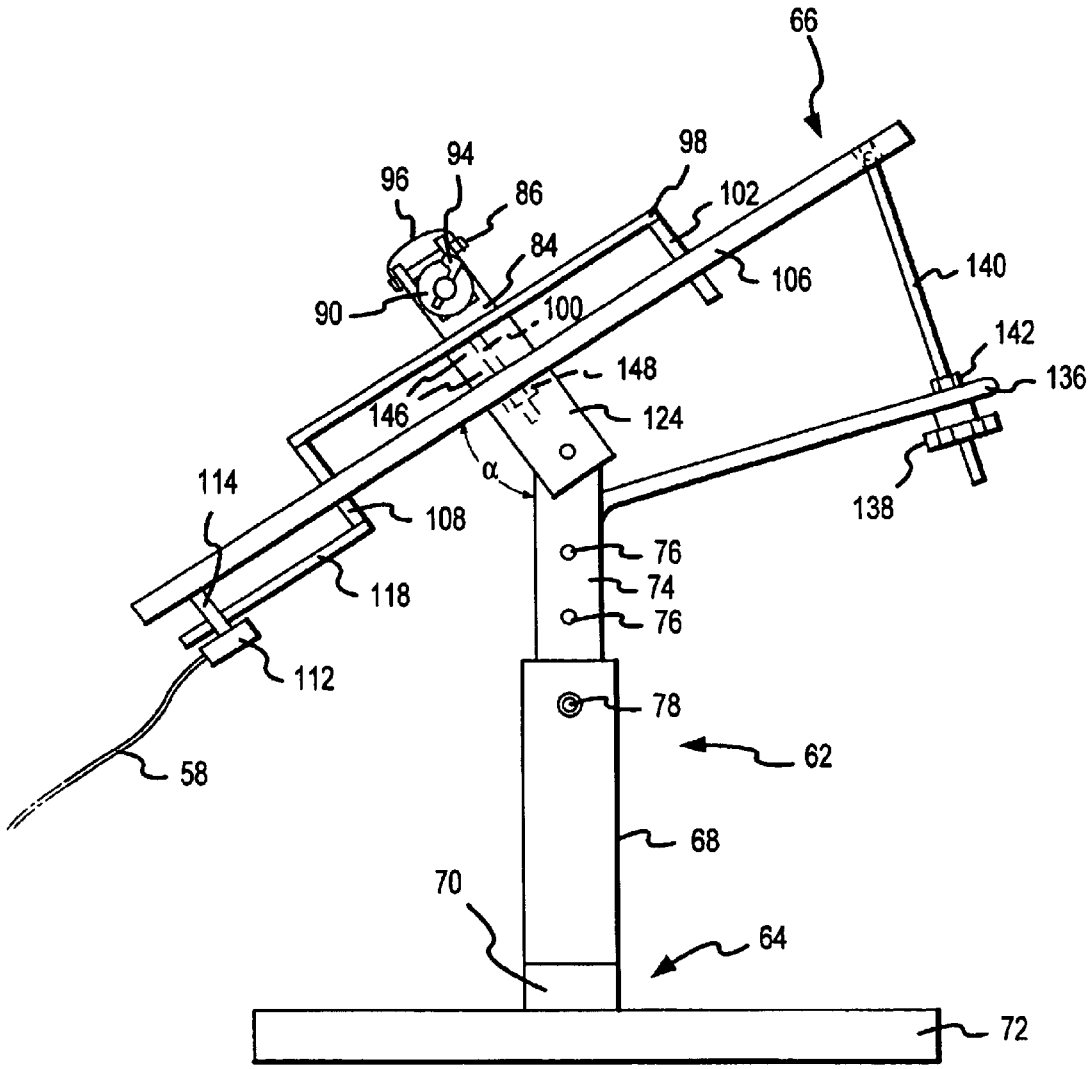

Referring now to FIGS. 1, 3*a* and 3*b*, bicycle apparatus 10 further includes a handlebar rotation sensor assembly 62. Handlebar rotation sensor assembly 62 suitably includes a base member 64 and a rotational member 66. Base member 64 includes an outer telescoping tube 68 attached to a horizontal support tube 70. Horizontal support tube 70 is attached to floor stand tubes 72. Inner telescoping tube 74 is positioned within outer telescoping tube 68 and may be height adjustable by pairs of positioning holes 76 which are positioned on opposing sides of inner telescoping tube 74. A pair of anchoring holes 80 are positioned on opposing sides of outer telescoping tube 68. The height of rotational member 66 may be adjusted and subsequently fixed into position by inserting a pin 78 through one hole of the pair of anchoring holes 80 of outer telescoping tube 68, then through a pair of opposing holes 76 of inner telescoping tube 74 and finally through the remaining hole of the pair of anchoring holes 80. While outer telescoping tube 68, horizontal support tube 70, floor stand tubes 72 and inner telescoping tube 74 are illustrated in FIGS. 1, 3*a* and 3*b* as square in shape, it will be appreciated that the tubes may be cylindrical or of any other suitable shape that permits opposing holes to be so positioned.

Alternatively, inner telescoping tube 74 may be height adjustable by a thread mechanism. Inner telescoping tube 74 may be cylindrical with helical threads on its outside perimeter surface and outer telescoping tube 68 may be cylindrical with helical threads on its inside diameter surface. By threading or unthreading inner telescoping tube 74 within outer telescoping tube 68, the height of inner telescoping tube 74 and, accordingly, rotational member 66 may be adjusted.

Figure 3C:
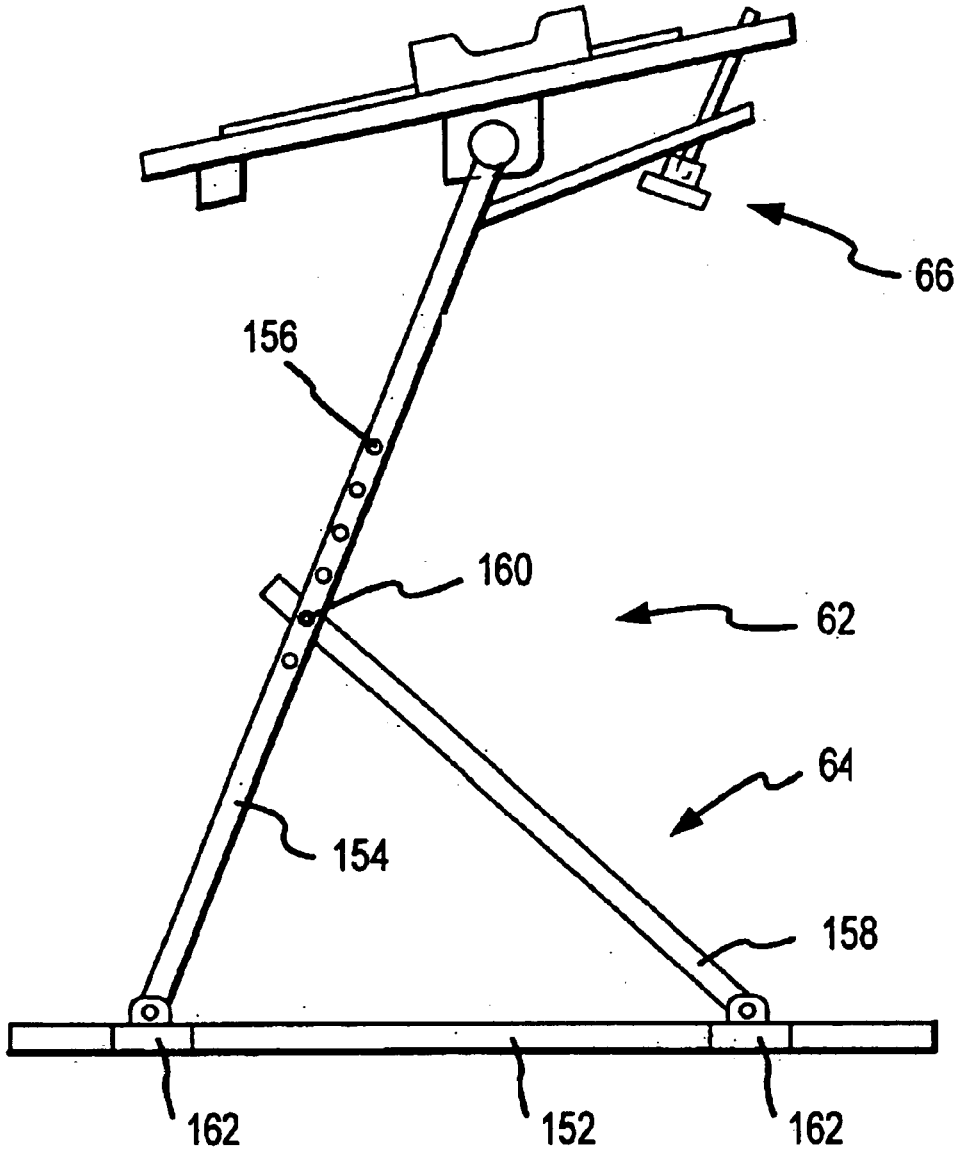

In yet another alternative embodiment, as shown in FIG. 3*c*, base member 64 may include at least two floor stand tubes 152, and at least two floor brace tubes 162 interposed and attached to floor stand tubes 152. A support rod 154 is pivotally attached at a first end to a first of the floor brace tubes 162 and pivotally attached at a second end to rotation member 66. Support rod 154 includes a plurality of position holes 156. A height adjustment rod 158 is pivotally attached at a first end to a second of the floor brace tubes 162. A pin 160 extends from a second end of height adjustment rod 158. The height of rotational member 66 may be adjusted by inserting pin 160 of height adjustment rod 158 into any one of the plurality of position holes 156. It will be appreciated that a variety of other well-known mechanisms may be employed to adjust the height of rotational member 66.

Referring again to FIGS. 1, 3*a* and 3*b*, rotational member 66 suitably includes plate 106 which may be fixedly attached at its back face to an anchoring bracket 124 by any suitable mechanism, such as welding or gluing, or by screws, pins or other suitable device. A control rod 98 is attached to an axle U-channel bracket 84. A pin 100 passes through the center of axle U-channel bracket 84, control rod 98, washers 146, plate 106 and the center of anchoring bracket 124, thereby permitting control rod 98 and axle U-channel bracket 84 to rotate about a longitudinal axis of pin 100 relative to rotational member 66. Pin 100 is locked into place proximate to anchoring bracket 124 by any suitable fixation device 148, such as a lock nut, pin or the like.

Figure 3D:
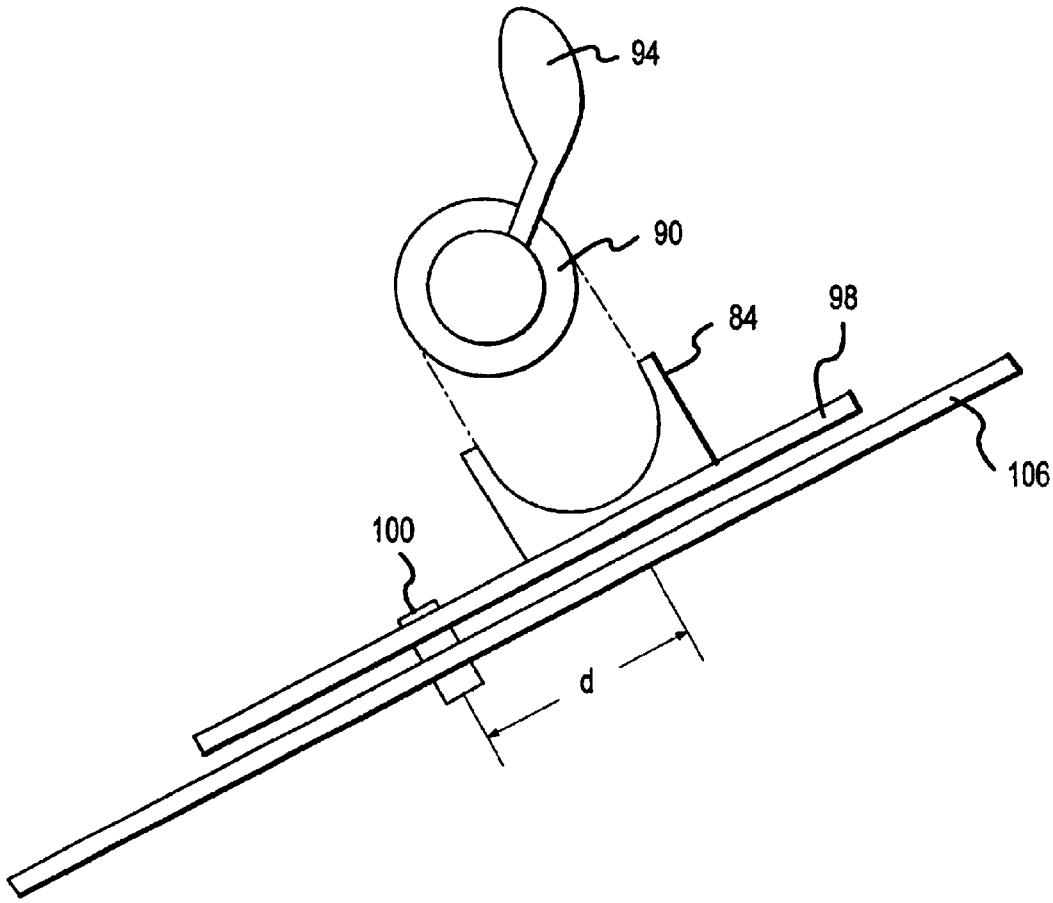
Figure 8:
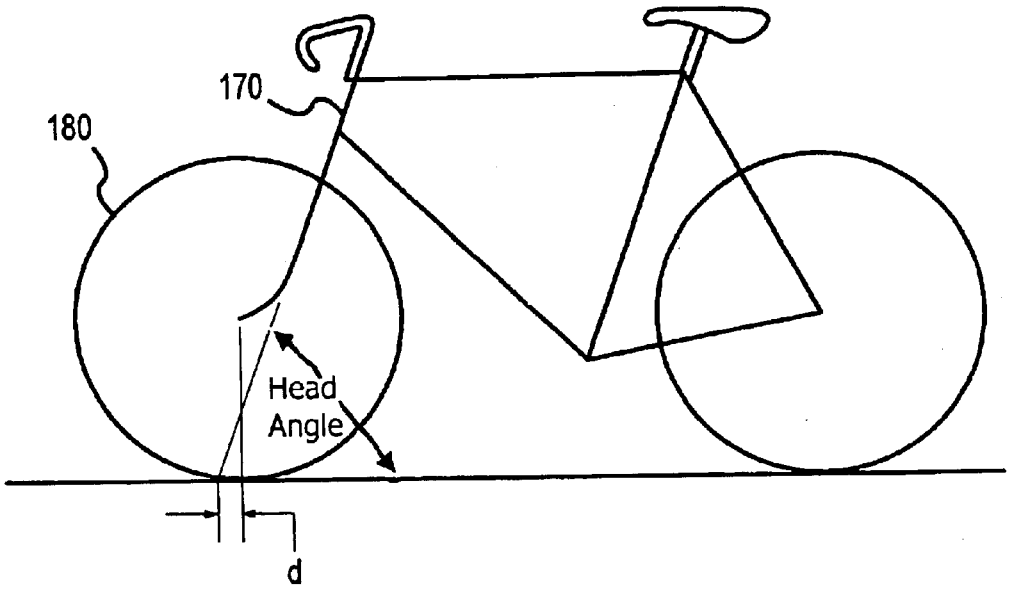
FIG. 8 is a side view illustration of the "offset" of a bicycle.

In an alternative embodiment of the present invention, as shown in FIG. 3*d*, U-channel bracket 84 is slidably attached to control rod 98 so that U-channel bracket 84 may be moved from the longitudinal axis of pin 100 by a desired distance "d" which represents the bicycle "offset." As illustrated in FIG. 8, offset "d" is the distance between where the front wheel 180 of the bicycle touches the ground and the point on the ground to which the "head angle" is projected, wherein the "head angle" of a bicycle is the angle of the steering column 170 as measured from the ground. By moving U-channel bracket 84 along control rod 98 a distance approximately equal to offset "d," preferably a distance in the range of approximately 1 inch to 1.5 inches, the bicycle "head angle" may be more closely simulated, thereby minimizing the movement of rear wheel 16 when the bicycle is in use. It will be appreciated that U-channel bracket 84 may be slidably attached to control rod 98 by a variety of well-known mechanisms, including set screws, clamps and the like.

Referring again to FIGS. 1, 3*a* and 3*b*, a hub 82 is suitably positioned within axle U-channel bracket 84 and is prevented from vertical movement by pins 86 which are inserted through holes 88 in axle U-channel bracket 84 and which are prevented from escaping holes 88 by positioning leads 96. Hub 82 includes an axle 92 and flanges 90. Flanges 90 are fixedly attached to the ends of hub 82 and are suitably configured to prevent hub 82 from sliding out of axle U-channel bracket 84. Alternatively, axle 92 may be fixedly attached to U-channel bracket 84 or directly to control rod 98 by any suitable fixation technique or device, such as screws or by soldering. Front forks 20 are positioned on axle 92 and are locked into place by an over-center cam lever 94, which is typically used on "quick release" bicycle front wheels.

Figure 4:
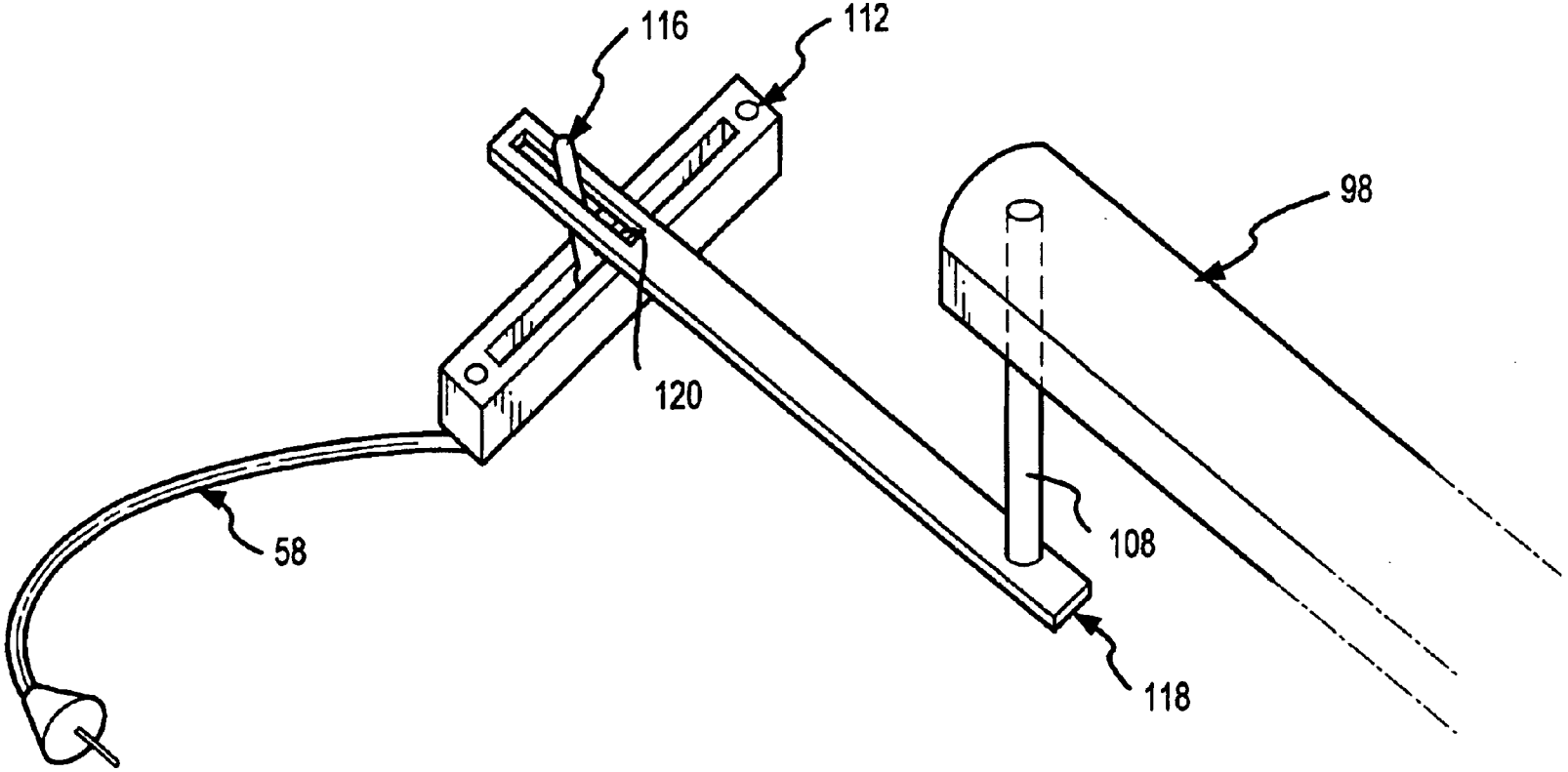
FIG. 4 is a perspective view of steering sensitivity potentiometer according to an embodiment of the present invention.

Referring now to FIGS. 3*b* and 4, control rod 98 has a proximate end and a distal end. A movement-limiting pin 102 extends perpendicularly from the proximate end of control rod 98 and into a proximate slot 104 of plate 106. Proximate slot 104 is arc-shaped and is configured to limit the movement of movement-limiting pin 102 and, accordingly, the rotation of control rod 98, thereby limiting the rotation of a handlebars 18 relative to bicycle frame 12. Attached to the distal end of control rod 98 is a suspension pin 108. Suspension pin 108 extends perpendicularly from control rod 98, through an arc-shaped distal slot 110 of plate 106, and is fixedly attached to a potentiometer control rod 118. A steering sensitivity potentiometer 112 is mounted to the underside of plate 106 by a set of mounting members 114. Steering sensitivity potentiometer 112 includes a movement potentiometer slide 116 which extends perpendicularly from steering sensitivity potentiometer 112, through a slot 120 at an end of potentiometer control rod 118. In operation, when handlebars 18 are rotated relative to frame 12, front wheel forks 20 cause axle 92 and, accordingly, control rod 98 to rotate relative to pin 100. When control rod 98 rotates about pin 100, suspension pin 108 moves within distal slot 110, causing potentiometer control rod 118 to move movement potentiometer slide 116, thereby activating steering sensitivity potentiometer 112. Steering sensitivity potentiometer 112 measures the amount of movement of movement potentiometer slide 116 and converts this into a signal which is then transmitted to digital signal processor 36 via cable 58. Digital signal processor 36 then converts this signal to an output signal proportional to the amount of rotation of handlebars 18 relative to bicycle frame 12. While FIG. 4 illustrates steering sensitivity potentiometer 112 as a linear potentiometer, it will be appreciated that steering sensitivity potentiometer 112 may be a rotational potentiometer, or any other device suitable to measure the rotation of control rod 98 about pin 100.

Referring back to FIG. 2*a*, steering scaling potentiometer 42 is suitably configured to be adjustable by a user to scale the signal representing the amount of rotation of handlebars 18. By scaling this signal, a user is able to adjust the synchronization of the rotation signal to on-screen characters or features of the video game. For example, in a motorcycle racing video game, the user may want to scale the rotation signal so that a 25 degree rotation of the handlebars represents 90 degrees of rotation of the motorcycle handlebars. Alternatively, in a car racing video game, the user may want to scale the rotation signal so that a 50 degree rotation of the handlebars represents a 90 degree rotation of a car steering wheel. Thus, by scaling the rotation signal, a user is able to synchronize rotation of the handlebars to video effects of a variety of video games or environmental simulations.

Figure 5:
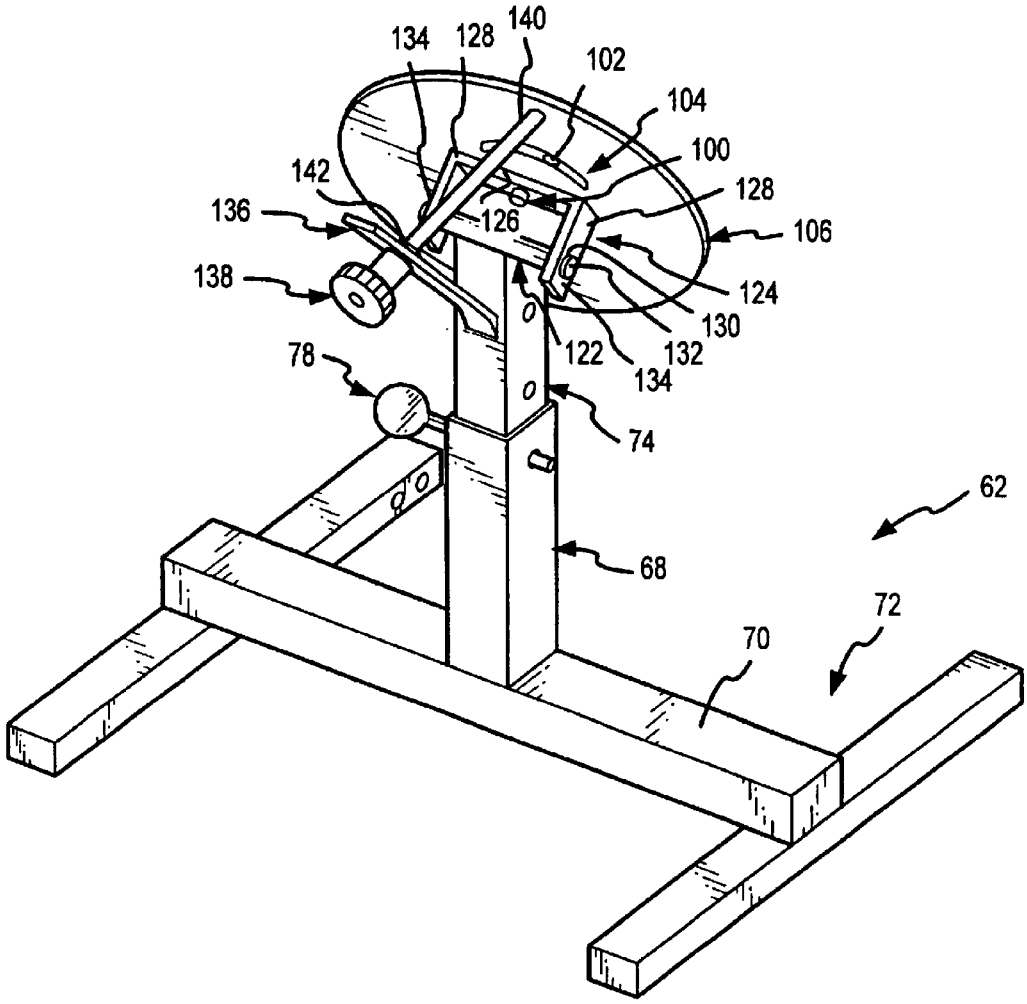
FIG. 5 is a perspective back view of a handlebar rotation sensor assembly according to an embodiment of the present invention.

Referring now to FIGS. 3*b* and 5, anchoring bracket 124 has a base 126 from which two side members 128 perpendicularly extend. Side members 128 each have a hole 130. A support hub 122, having a central bore, is interposed between side members 128 so that the longitudinal axis of the central bore is collinear with the central axes of holes 130. Support hub 122 is attached to inner telescoping tube 74. A support axle 132 extends from one of the holes 130 through the central bore of support hub 122 and through the remaining hole 130 so that anchor bracket 124 and, accordingly, plate 106 are permitted to rotate about support axle 132. Anchor bracket 124 is prevented from movement along the longitudinal axis of support axle 132 by fixation devices 134 positioned on both ends of support axle 132 adjacent to side members 128. Fixation devices 134 may be lock nuts, pins, or any other suitable fixation mechanism.

The angle $\alpha$ of plate 106 relative to inner telescoping tube 74 may be adjusted by use of a bracing assembly which includes an angle bracket 136, an adjustment knob 138, a threaded carriage bolt 140 and a nut 142. Carriage bolt 140 is pivotally attached at a proximate end to the back face of plate 106 and extends through a hole in angle bracket 136. Angle bracket 136 is attached to inner telescoping tube 74 by any suitable mechanism, such as by welding or gluing, or by a suitable fixation device such as a screw and nut configuration. Adjustment knob 138 is threaded onto the distal end of carriage bolt 140. As adjustment knob 138 is threaded closer to the proximate end of carriage bolt 140, angle a increases, that is, plate 106 becomes more aligned with a horizontal plane. As adjustment knob 138 is threaded closer to the distal end of carriage bolt 140, angle $\alpha$ decreases and plate 106 becomes more aligned with a vertical plane. When the desired angle $\alpha$ is determined, nut 142 may be threaded along carriage bolt 140 to secure carriage bolt 140 in position relative to angle bracket 136. By adjusting the angle $\alpha$, the user is able to simulate the true steering angle of the bicycle when the front wheel is in place, thereby reducing the amount of frame and rear wheel movement. By reducing the amount of frame and rear wheel movement, the user is able to reduce the stress on the bike frame, wear on the rear tire while on the trainer, and the possibility of the rear wheel disengaging from the trainer while in use (which could result in injury to the user).

Figure 6:
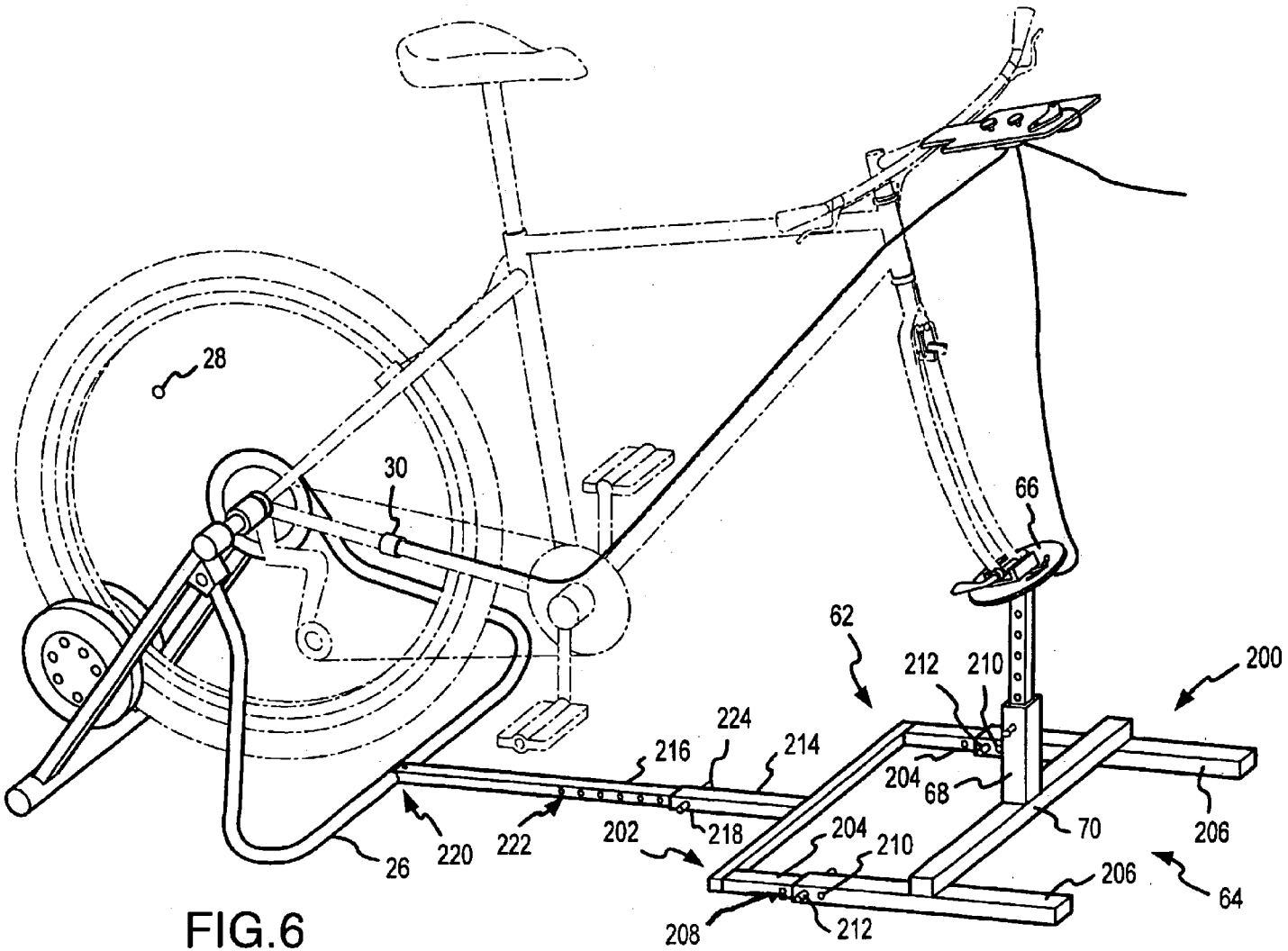
FIG. 6 is a side view illustration of a stationary bicycle apparatus according to another embodiment of the present invention.

Referring now to FIG. 6, an alternative embodiment of the present invention, bicycle apparatus 200, may include a telescoping device which is configured to connect bicycle trainer 26 to base member 64 of handlebar rotation sensor assembly 62 for improved stability and to reduce or, preferably, eliminate movement of bicycle frame 12 caused from movement of rotational member 66. A U-shaped member 202 has two inner telescoping tubes 204. Two hollow floor stand tubes 206 are attached to horizontal support tube 70 to support handlebar rotation sensor assembly 62. Inner telescoping tubes 204 are slidably received into floor stand tubes 206. A plurality of pairs of opposing holes 208 are aligned horizontally along sidewalls of inner telescoping tubes 204. Sidewalls of floor stand tubes 206 have a similarly configured pair of opposing holes 210. To anchor U-shaped member 202 to base member 64, the user may insert inner telescoping tubes 204 into floor stand tubes 206, align the pair of holes 210 of floor stand tubes 206 with one of the pairs of holes 208 of both inner telescoping tubes 204, and insert pins 212 through the pairs of holes 208 and holes 210 of each inner telescoping tube 204 and floor stand tube 206, respectively. Alternatively, inner telescoping tubes 204 may be advanced into and anchored to floor stand tubes 206 via a threading mechanism, that is, inner telescoping tubes 204 may be cylindrical with helical threads on their outside perimeter surfaces and configured to rotate about their longitudinal axes relative to U-shaped member 202. Floor stand tubes 206 also may be cylindrical with helical threads on their inside diameter surfaces and inner telescoping tubes 204 may be threaded into floor stand tubes 206 a desired distance.

An outer connector tube 214 is attached to U-shaped member 202 by any suitable fixation mechanism, such as welding, gluing or the like. Alternatively, outer connector tube 214 may be attached to U-shaped member 202 via suitable fixation devices, such as screws. Outer connector tube 214 is hollow and is configured to slidably receive a proximate end of an inner connector tube 216. A distal end of inner connector tube 216 is attached to bicycle trainer 26 by a clamp 220 or any other suitable attachment device. Sidewalls of outer connector tube 214 have a pair of opposing holes 218 and sidewalls of inner connector tube 216 have a plurality of pairs of opposing holes 222. A user may adjust bicycle apparatus 200 to fit a conventional bicycle, with the front wheel removed and the back wheel 16 suitably operational with bicycle trainer 26, by inserting inner connector tube 216 into outer connector tube 214 to a desired extent, aligning a pair of holes 222 of inner connector tube 216 with the pair of holes 218 of outer connector tube 214 and inserting a pin 224 through the aligned holes. While outer connector tube 214, floor stand tubes 206, inner telescoping tubes 204 and inner connector tube 216 are illustrated in FIG. 6 as square-shaped, it will be appreciated that these tubes may be cylindrical or of any other suitable shape that permits the opposing holes to be so aligned.

In an alternative embodiment of the present invention, inner connector tube 216 may be adjustably connected to outer connector tube 214 via a thread mechanism. Inner connector tube 216 may be cylindrical with helical threads on its outside perimeter surface and outer connector tube 214 may be cylindrical with helical threads on its inside diameter surface. A user may adjust bicycle apparatus 200 to fit a bicycle by threading inner connector tube 216 into outer connector tube 214 a desired distance.

Figure 7:
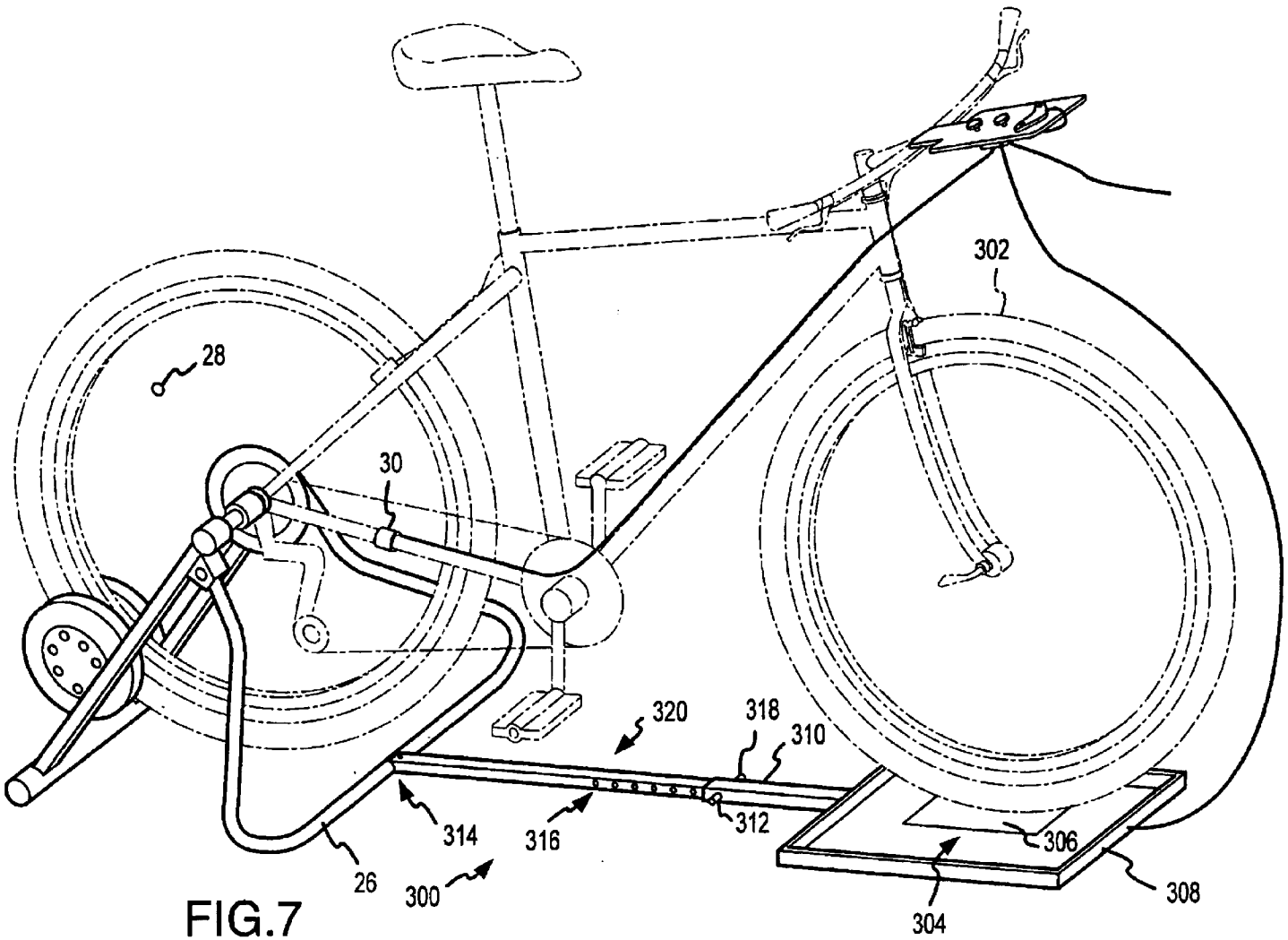
FIG. 7 is a side view illustration of a stationary bicycle apparatus according to yet another embodiment of the present invention.

FIG. 7 illustrated yet another embodiment of the present invention. Bicycle apparatus 300 includes a telescoping device which is configured to connect bicycle trainer 26 to a front wheel sensing device 304 that measures the rotation of a front bicycle wheel 302 relative to frame 12. Such front wheel sensing devices are known in the prior art, such as the type incorporated in the GAMEbike™ virtual trainer. Typically, front wheel sensing devices 304 have a tray 306 that rotates about an axle (not shown) when handlebars 18 are rotated relative to frame 12. When tray 306 rotates, it activates a potentiometer or other sensing device.

Tray 306 is supported by a base 308. Base 308 is attached to an outer telescoping tube 310. Outer telescoping tube 310 has a pair of opposing holes 312 and is configured to slidably receive an inner telescoping tube 320. A first end of inner telescoping tube 320 is attached to bicycle trainer 26 by a clamp 314 or any other suitable attachment device. Alternatively, inner telescoping tube 320 may be welded or glued to bicycle trainer 26. A second end of inner telescoping tube 320 has a plurality of pairs of opposing holes 316. A user may adjust bicycle apparatus 300 to fit a conventional bicycle, with the back wheel suitably operational with bicycle trainer 26, by inserting inner telescoping tube 320 into outer telescoping tube 310 to a desired extent, aligning a pair of holes 316 of inner telescoping tube 320 with the pair of holes 3 12 of outer telescoping tube 310, and inserting a pin 318 through the aligned holes.

In an alternative embodiment of the present invention, inner telescoping tube 320 may be adjustably connected to outer telescoping tube 310 via a thread mechanism. Inner telescoping tube 320 may be cylindrical with helical threads on its outside perimeter surface and outer telescoping tube 310 may be cylindrical with helical threads on its inside diameter surface. A user may adjust bicycle apparatus 300 to fit a bicycle by threading inner telescoping tube 320 into outer telescoping tube 310 a desired distance.

The above-described embodiments may also be employed when it is desirable to prevent handlebars 18 from rotating relative to bicycle frame 12. The rotation of handlebars 18 may be simulated by employing buttons or other suitable actuators which provide signals to digital signal processor 36 representing the desired amount of simulated rotation. For example, left action buttons member 50 and right action buttons member 52 may each include a button which, when pressed, simulates rotating the handlebars to left and to the right, respectively. The more times the button is pushed, or alternatively, the longer the button is pressed, the greater the rotation that is simulated.

Although the subject invention has been described herein in conjunction with the appended drawing Figures, it will be appreciated that the scope of the invention is not so limited. Various modifications in the arrangement of the components discussed and the steps described herein for using the subject device may be made without departing from the spirit and scope of invention as set forth in the appended claims.

I claim:

1. An apparatus for synchronizing the movement of a stationary bicycle with video effects produced on a video display associated with a computer, wherein said bicycle has a rear wheel, handlebars, and a pair of front wheel forks operatively engaged with said handlebars, said apparatus comprising:

(a) a motion sensor configured to produce a rear wheel rotation signal which corresponds to the rotation of said rear wheel;

(b) a handlebar rotation sensor assembly configured to engage said pair of front wheel forks and to produce a handlebar rotation signal which corresponds to the rotation of said handlebars about an axis, wherein said handlebar rotation sensor assembly comprises:

(1) a plate having a first face, a second face, a first portion, a second portion and an axis;

(2) a base support assembly connected to said plate;

(3) a rotation member having a first end and a second end, wherein said rotation member is positioned adjacent said first face of said plate and configured to rotate about said axis of said plate;

(4) a support assembly attached to said rotation member and configured to support said pair of front wheel forks; and (5) a rotation-measuring assembly attached to said rotation member and configured to measure the rotation of said rotation member about said axis, wherein when said pair of front wheel forks is rotated, said rotation-measuring assembly produces a signal representing said rotation; and (c) a digital signal processor configured to receive said rear wheel rotation signal and said handlebar rotation signal and to transmit output signals to said computer so that a user of said bicycle may interact with said video effects by rotating said rear wheel and said handlebars.

2. The apparatus of claim 1 further comprising a speed scaling potentiometer configured to permit scaling of the rear wheel rotation signal.

3. The apparatus of claim 1 further comprising a steering scaling potentiometer configured to permit scaling of the handlebar rotation signal.

4. The apparatus of claim 1 wherein said plate further comprises a first arc-shaped cutout positioned at said first portion of said plate and wherein said rotation-measuring assembly comprises:

(a) a suspension pin fixedly attached to said first end of said rotation member and extending through said first arc-shaped cutout of said plate;

(b) a control rod fixedly attached to said suspension pin; and (c) a potentiometer operatively engaged with said control rod.

5. The apparatus of claim 1 wherein said base support assembly comprises a base and a pivot member fixedly attached to said second face of said plate and pivotally engaged with said base so that said plate can pivot about a horizontal axis.

6. The apparatus of claim 5 further comprising a bracing assembly connected at a first end to said base and connected at a second end to said plate to prevent rotation of said plate about said horizontal axis.

7. The apparatus of claim 6 wherein said bracing assembly comprises:

(a) a first brace member attached at a first end to said base;

(b) a second brace member pivotally attached at a first end to said second face of said plate and slidably engaged at a second end with a second end of said first brace member; and (c) a locking device configured to prevent slidable relative movement between said first brace member and said second brace member.

8. The apparatus of claim 1 wherein said support assembly comprises:

(a) a bracket having a base and two side members extending from said base, wherein said base is attached to said rotation member;

(b) a hub interposed between said side members of said bracket and having a bore extending along a central longitudinal axis; and (c) an axle extending through said bore of said hub and configured to support said pair of front wheel forks.

9. The apparatus of claim 4 wherein said plate further comprises a second arc-shaped cutout positioned at said second portion of said plate, and wherein said second arc-shaped cutout is smaller than said first arc-shaped cutout and wherein said apparatus further comprises a rotation-limiting pin fixedly attached to said second end of said rotation member and extending through said second arc-shaped cutout of said plate.

10. The apparatus of claim 5 further comprising a rear wheel support assembly removably connected to said stationary bicycle and configured to permit rotation of said rear wheel of said stationary bicycle.

11. The apparatus of claim 10 wherein said apparatus further comprises a stabilizing member attached at a first end to said rear wheel support assembly and attached at a second end to said base.

12. The apparatus of claim 11 wherein said stabilizing member comprises:

(a) a first telescoping member attached at a first end to said rear wheel support assembly;

(b) a second telescoping member connected to said base and configured to slidably receive a second end of said first telescoping member; and (c) an anchoring device configured to prevent relative movement between said first telescoping member and said second telescoping member.

13. The apparatus of claim 11 wherein said stabilizing member comprises:

(a) a first member having a series of helical threads on an outside diameter surface of a first end, wherein said first member is attached at a second end to said rear wheel support assembly; and (b) a second member having a series of helical threads on an inside diameter surface, wherein said second member is connected to said base and configured to receive said first end of said first member;

wherein said first end of said first member may be threaded into said second member a desired distance.

14. The apparatus of claim 1 further comprising a rear wheel support assembly removably connected to said stationary bicycle and configured to permit rotation of said rear wheel of said stationary bicycle.

15. The apparatus of claim 14 wherein said apparatus further comprises a stabilizing member attached at a first end to said rear wheel support assembly and attached at a second end to said handlebar rotation sensor assembly.

16. The apparatus of claim 15 where said stabilizing member comprises:

(a) a first telescoping member attached at a first end to said rear wheel support assembly;

(b) a second telescoping member connected to said handlebar rotation sensor assembly and configured to slidably receive a second end of said first telescoping member; and (c) an anchoring device configured to prevent relative movement between said first telescoping member and said second telepscoping member.

17. The apparatus of claim 15 wherein said stabilizing member comprises:

(a) a first member having a series of helical threads on an outside diameter surface of a first end, wherein said first member is attached at a second end to said rear wheel support assembly; and (b) a second member having a series of helical threads on an inside diameter surface, wherein said second member is connected to said handlebar rotation sensor assembly and configured to receive said first end of said first member;

wherein said first end of said first member may be threaded into said second member a desired distance.

18. The apparatus of claim 1 wherein said apparatus further comprises at least one user-controlled actuator in electrical communication with said digital signal processor for causing user commands to be transmitted to said computer by said digital signal processor.

19. The apparatus of claim 1 wherein said base support assembly is height-adjustable.

20. The apparatus of claim 1 wherein said support assembly is adjustably attached to said rotation member.

21. An apparatus for synchronizing the movement of a stationary bicycle with video effects produced on a video display associated with a computer, wherein said bicycle has a rear wheel, handlebars and a front wheel, said apparatus comprising:

(a) a motion sensor configured to produce a rear wheel rotation signal which corresponds to the rotation of said rear wheel;

(b) a handlebar rotation sensor assembly configured to support said front wheel and to produce a handlebar rotation signal which corresponds to the rotation of said handlebar about an axis;

(c) a digital signal processor configured to receive said rear wheel rotation signal and said handlebar rotation signal and to transmit output signals to said computer so that a user of said bicycle may interact with said video effects by rotating said rear wheel and said handlebars;

(d) a rear wheel support assembly removably connected to said stationary bicycle and configured to permit rotation of said rear wheel of said stationary bicycle; and (e) a stabilizing member attached at a first end to said rear wheel support assembly and attached at a second end to said handlebar rotation sensor assembly, wherein said stabilizing member comprises:

(1) a first telescoping member attached at a first end to said rear wheel support assembly;

(2) a second telescoping member connected to said handlebar rotation sensor assembly and configured to slidably receive a second end of said first telescoping member; and (3) an anchoring device configured to prevent relative movement between said first telescoping member and said second telescoping member.

22. The apparatus of claim 21 wherein said stabilizing member comprises:

(a) a first member having a series of helical threads on an outside diameter surface of a first end, wherein said first member is attached at a second end to said rear wheel support assembly; and (b) a second member having a series of helical threads on an inside diameter surface, wherein said second member is connected to said handlebar rotation sensor assembly and configured to receive said first end of said first member;

wherein said first end of said first member may be threaded into said second member a desired distance.

23. The apparatus of claim 21 further comprising a speed scaling potentiometer configured to permit scaling of the rear wheel rotation signal.

24. The apparatus of claim 21 further comprising a steering scaling potentiometer configured to permit scaling of the handlebar rotation signal.

25. The apparatus of claim 21 wherein said apparatus further comprises at least one user-controlled actuator in electrical communication with said digital signal processor for causing user commands to be transmitted to said computer by said digital signal processor.

26. The apparatus of claim 21 wherein said handlebar rotation sensor is height-adjustable.

* * * * *